United States Patent [19]

Carini

[11] Patent Number: 4,871,170

[45] Date of Patent: Oct. 3, 1989

[54] SQUEEZE SPORT

[75] Inventor: Ed Carini, Mahopac, N.Y.

[73] Assignee: The Astro-Stream Corporation, Levittown, N.Y.

[21] Appl. No.: 178,179

[22] Filed: Apr. 6, 1988

[51] Int. Cl.[4] ..... A63F 9/00; A63B 67/14

[52] U.S. Cl. ..... 273/126 R; 273/129 P; 273/85 F; 273/127 D

[58] Field of Search ..... 273/127 D, 127 B, 126 R, 273/129 P, 85 R, 86 D, 424, 119 R, 108; 124/10, 127 R, 42; 30/120.2 T; 446/429

[56] References Cited

U.S. PATENT DOCUMENTS

| | | | |
|---|---|---|---|
| 358,733 | 10/1931 | Gillard | 273/129 P |
| 930,796 | 8/1909 | Quackenbush | 30/120.4 |
| 2,252,451 | 8/1941 | Anderson | 273/108 |
| 3,887,187 | 6/1975 | Crossman et al. | 273/126 A |
| 3,940,135 | 2/1976 | Cohen | 273/85 F |
| 4,167,267 | 9/1979 | Romero et al. | 273/95 E |
| 4,215,863 | 8/1980 | Kuiper | 273/126 R |
| 4,318,388 | 3/1982 | Fogarty et al. | 124/10 |

FOREIGN PATENT DOCUMENTS

| | | | |
|---|---|---|---|
| 261321 | 5/1963 | Australia | 273/127 D |
| 1432856 | 4/1976 | United Kingdom | 273/129 P |

OTHER PUBLICATIONS

World Wide Games, Catalog (1988), pp. 2–7, 10, 13.

*Primary Examiner*—Edward M. Coven
*Assistant Examiner*—S. Passaniti
*Attorney, Agent, or Firm*—Nolte, Nolte and Hunter

[57] ABSTRACT

Gaming apparatus for a table hockey-type game in which a puck is projected across a playing field by a squeeze apparatus which may be operated by the fingers of one hand. A plurality of goals may serve either as goals or barriers according to the requirements of different variations of the game. The playing field comprises a flat surface bounded by walls at the corners of which the goals are located. The squeeze apparatus comprises a pair of arms each connected to the other by a curved spring which biases the arms towards an acute angle to each other. The squeeze apparatus is also used for goal tending.

19 Claims, 3 Drawing Sheets

SQUEEZE SPORT

FIELD OF INVENTION

This invention relates to a table hockey-type game, particularly a game in which pucks are projected across a playing surface by a squeeze apparatus which may be operated by the fingers of one hand. A plurality of goal means may serve either as goals or barriers according to the requirements of various variations of the game. The squeeze apparatus is also used for goal tending.

BACKGROUND OF THE INVENTION

Various table hockey games are known in the art. For example, Crossman et al., U.S. Pat. No. 3,887,187 issued June 3, 1975 for an AIR CUSHION TABLE GAME refers to a game in which a puck floats upon an air cushion table propelled by disc shaped bats. Cohen U.S. Pat. No. 3,940,135 issued Feb. 24, 1976 for a HOCKEY GAME refers to a hockey game in which magnetic team members are attracted by a magnetic actuator to hit and propel a puck.

Fogarty et al., U.S. Pat. No. 4,318,388 issued Mar. 9, 1982 for a LAUNCHING DEVICE USING PINCHING FORCE, refers to a toy device for launching a disc comprising a pair of opposed dog-legged arms, each with an open channel for engaging a rim of a disc and a handle for grasping by the user. The user grasps the handles with two hands and rapidly moves them into a spread-apart configuration. The handles move the channels into a close-spaced configuration resulting in a force on the rim of the disc which impels the toy missile outward.

BRIEF DESCRIPTION

It is an object of the present invention to provide a relatively small, lightweight, inexpensive, simple gaming apparatus in which one or more players can engage in a fast-moving, exiting hockey-type game, in which the players propel a projectile towards one or more goals with one hand by means of a squeeze apparatus, and prevent the puck from entering a goal, by means of the same squeeze apparatus. The gaming apparatus of the present invention comprises the following.

A puck means may be any device suitable for projecting across a flat playing surface, but is preferably a puck in the shape of a cylindrical disc. The puck is to be projected across a flat surface such as a vacu-formed or molded plastic playing table bounded on a plurality of sides by wall means such as four walls. The walls may either be molded or formed with the playing surface, or may be demountable or foldable for easy storage. The puck is projected across the playing surface by a squeeze apparatus comprising a pair of arms, each of which is connected to the other by a spring means which biases the arms at an acute angle to each other.

In operation, the puck is grasped by the squeeze apparatus, hereinafter the squeezer, which is then directed toward a goal and squeezed by the action of two or more fingers. This generates a propelling force along the inner surfaces of the arms which propels the puck in the intended direction.

The goal toward which the puck is propelled is a goal means comprised of pedestal means, preferably a plurality of pedestals, mountable by vertical insertion in a horizontally secure fashion so that the pedestals resist the horizontal impact of the puck. A barrier means is pivotably attached by hinge means to the pedestals, oriented horizontally across one side of the pedestals, so that when the puck collides with the barrier from a direction on the barrier side, any motion of the barrier is halted by the pedestals, and the puck rebounds. If the puck collides with the barrier from a direction on the pedestal side, the barrier pivots on its hinges and allows the puck to pass. After the puck clears the barrier, the barrier falls towards its closed position and traps the puck in the goal area, since the puck would be colliding with the barrier from the barrier side as the puck leaves the goal. The goal can be oriented so that either the barrier side or the pedestal side, opposite the barrier side, may be presented to the playing surface. With the barrier side presented, the goal is closed and merely presents another wall for the puck to rebound from, but with its pedestal side presented to the playing field, the goal is open and serves as a goal.

The squeezer also serves a defensive function in blocking the puck from the goal by catching or deflecting the puck or by intercepting the puck and shooting it back almost instantly.

DESCRIPTION OF PREFERRED EMBODIMENT

Figure 1:
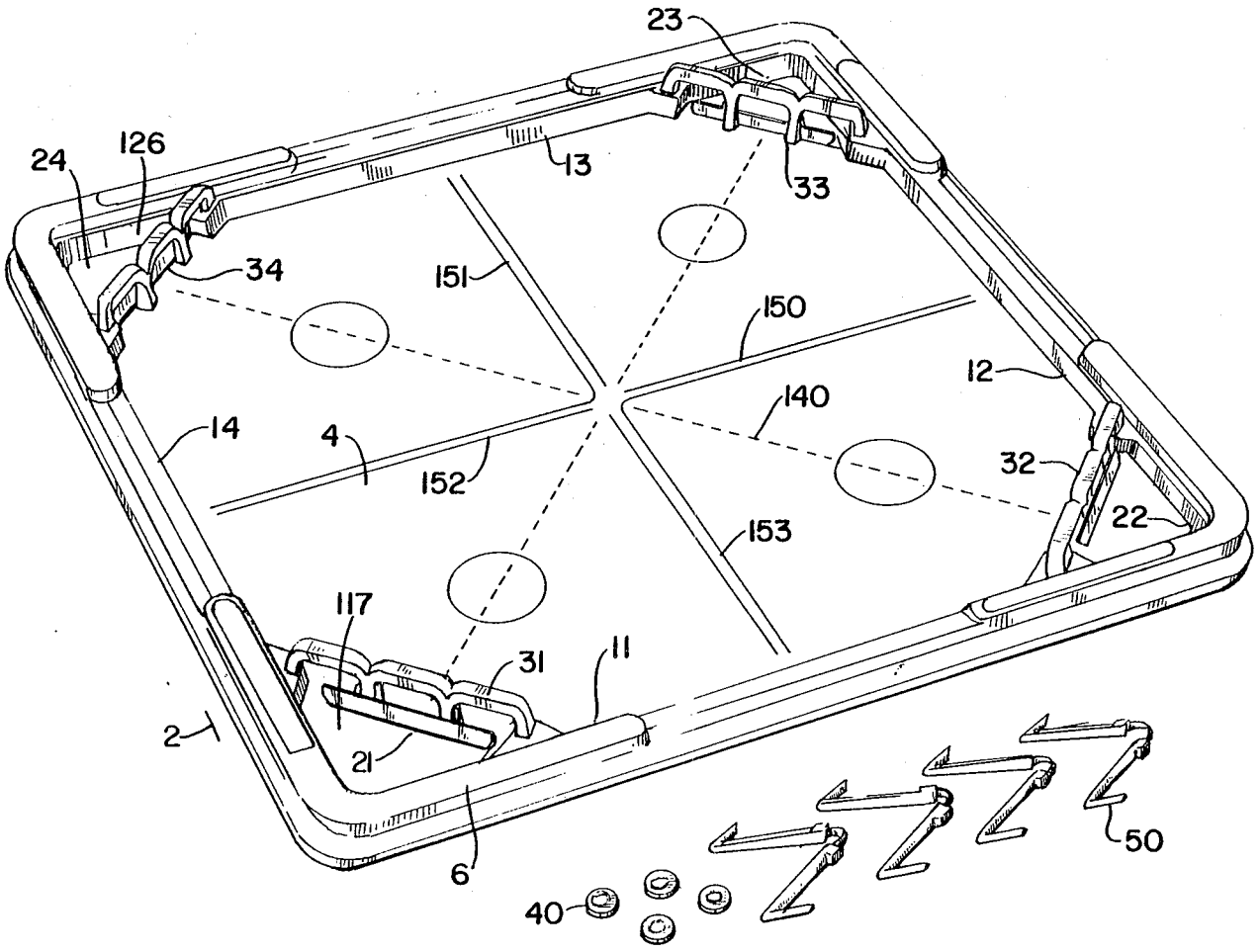
FIG. 1 is an oblique view of the complete gaming apparatus.

FIG. 1 is an oblique view of the collected gaming apparatus. A playing field means such as the playing field, generally designated 2, comprises playing surface 4 and wall means 6. Wall means 6, comprises walls 11, 12, 13 and 14. Corners 21, 22, 23 and 24 are formed at the intersections of walls 11–14 and are separated from the main portion of playing surface 4 by goals 31, 32, 33 and 34. In another embodiment, the playing field may be formed by walls, hinged or demountable at their corners, which may be set up on a common flat surface such as a table to define a playing surface. The angles formed by the corners of such walls may be triangulated and thus stabilized by spanning the corners with goals such as described below, attached to the walls. In the presently preferred embodiment, the playing field is shaped as a square having three-foot sides.

Figure 2:
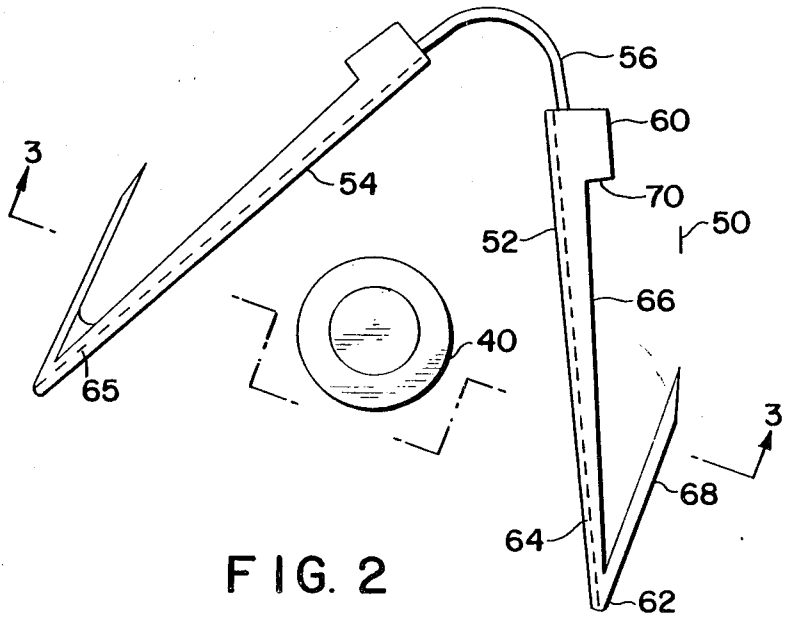
FIG. 2 is a top view of a squeezer and a puck.

Puck means, such as puck 40, may be placed on playing surface 4 and propelled towards a designated goal by squeeze apparatus such as squeezer 50. As shown in FIG. 2, squeezer 50 comprises a pair of arms 52, 54, each connected to the other by spring means such as spring 56. Spring 56 biases the arms towards an acute angle, such as fifty-five degrees, to each other. Each arm has a proximal end 60, proximal to the spring, a distal end 62, an inner surface 64, and an outer surface 66. Outer surface 66 has a finger-guard 68 at its distal end and a lip means such as lip 70 at its proximal end. Finger-guard 68 protects fingers from fast-moving pucks. Guard 68 extends from the distal end 62 at an acute angle to arm 52, 54, in a proximal direction for a substantial distance to cover the player's fingers. Lip 70 prevents fingers from slipping off the proximal end 60.

In other embodiments, the squeezer can be a simple piece of spring steel bent to an approximate "V" similar in shape to the squeezer described above. In another embodiment, the entire squeezer would be made of plastic having arms which are somewhat thicker and, therefore, more rigid than the more flexible section which would serve as the spring means.

In use, the squeezer is positioned so that puck 40 is encompassed within the "V" formed by arms 52, 54. Pressure is applied by the thumb and forefinger, or by the thumb and four fingers or any number of fingers that feels comfortable to the individual, to the outer surface 66 of each arm 52 and 54. Arms 52, 54 squeeze puck 40 between the inner surfaces 64, 65 of arms 52, 54 and causes a propulsive force to expel puck 40 from squeezer 50.

The squeezer apparatus will be about four inches between distal end 62 and the apex of the spring means. Launch characteristics of the puck will vary owing to the flexibility of the spring means and, to some degree, to flexibility in the arms, according to where the thumb and fingers are placed along the arms and how pressure is applied. For example, a desirable launch characteristic may be achieved by beginning the application of pressure with the fingers located toward the proximal end and increasing the pressure on the fingers near the distal end as the puck travels past the distal end. Skill and technique can be achieved more through practice than by any other means. After only a little practice, the player can be projecting the puck at incredibly high speeds so that blocking the goal is a challenging exercise requiring extremely fast reflexes, clever anticipation and more than a little luck. The puck sometimes moves so fast that it is difficult to see. Whether a player uses the thumb and forefinger or the thumb and four fingers or some other number of fingers is a matter of personal preference.

Figure 3:
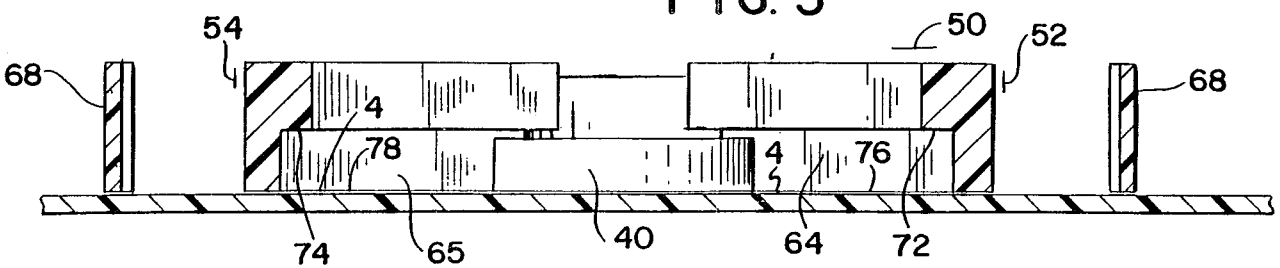
FIG. 3 is a front view taken in section through the squeezer along a plane indicated in FIG. 2 by line 3. The puck is not sectioned.

In a further refinement of the squeezer, FIG. 3 shows the squeezer sectioned along a plane designated 3 in FIG. 2. Puck 40 is shown but not in section. Inner surfaces 64, 65 comprise ridge means 72 disposed in parallel-spaced relationship to a bottom edge 76, 78 substantially the entire length of each inner surface 64, 65 so that when the apparatus is placed on a flat surface 4, surface 4 cooperates with ridges 72, 74 to form a channel associated with each arm 52, 54. The height of ridges 72, 74 above surface 4 is such that puck 40 fits within the channels formed thereby. This prevents puck 40 from being accidentally squeezed over the top of the squeezer rather than in the intended direction.

Figure 4:
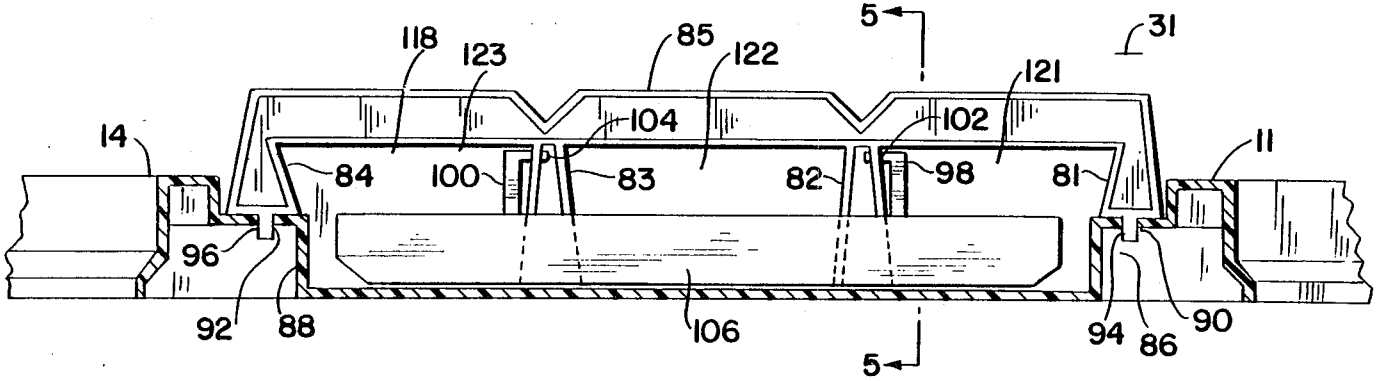
FIG. 4 is a view from the barrier side of a goal.
Figure 5:
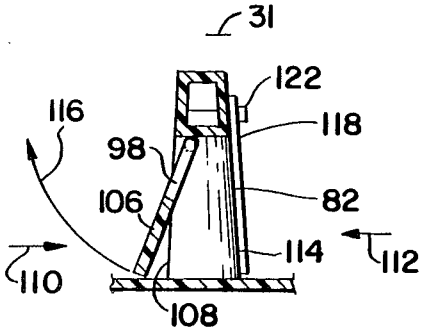
FIG. 5 is a side view of the goal, sectioned in the plane indicated by line 5 in FIG. 4.

Goal means such as goal 31 is shown in FIG. 4. FIG. 5 shows a side view of this goal taken in section through a plane indicated in FIG. 4. Goal 31 (FIG. 4) comprises pedestal means such as pedestals 81, 82, 83 and 84. As a structural matter, bridge means such as bridge 85 joins pedestals 81–84 to create a unified goal structure. Walls 11 and 14 include projections 86, 88 which have, in their horizontal surfaces, holes 90, 92 which serve as sockets for pins 94, 96, which project from the bottoms of pedestals 81, 84. Hinge means comprising hinges 98, 100 are pinned into holes 102, 104 on pedestals 82, 83. Barrier means such as barrier 106 is mounted on hinges 98, 100 and is oriented horizontally across a barrier side 108 (FIG. 5) of pedestals 82 and 83 (FIG. 4). Thus, (FIG. 5) when a puck collides with barrier 106 from a direction 110 of barrier side 108, any motion of barrier 106 is halted by pedestals 82, 83 and the puck rebounds. This occurs when the barrier side of goal 31 is oriented outward toward the playing field. Thus, the goal is kept closed and serves as a wall means to confine the puck to the playing surface 4.

However, when goal 31 is lifted up, turned around to the opposite orientation and placed in holes 90, 92, as shown in FIG. 4 and in FIG. 1, so that barrier 106 swings on its hinge means inward toward corner 21, the puck would come from a direction corresponding in FIG. 5 to direction 112, from the pedestal side 114 of pedestal 82. When the puck 40, which is heavier than barrier 106, impacts on barrier 106 from direction 112, barrier 106 swings on hinge 92 in arc 116, upward and out of the way of the puck, which then can freely pass into goal area 117. The barrier then drops below the upper edge of the puck and prevents it from leaving goal area 117 in a similar manner to that described in the previous paragraph, because the goal area is on the barrier side of goal 31.

Closure means, such as closure 118, may also be provided and secured to bridge 120 by means of pegs such as 122 to cover an opening on the pedestal side of goal 31. One or more of these closures can be attached across the openings 121, 122 and 123 between the pedestals 81–84 in order to effect partial closure of the goal and render the goal harder to make without obstructing it completely. Returning to FIG. 1, foam bumpers such as 126 can be seen lining the walls of corner 24 in order to lessen the rebound of the puck within the goal area of corner 24. Similar bumpers are affixed to all the corners.

Figure 6:
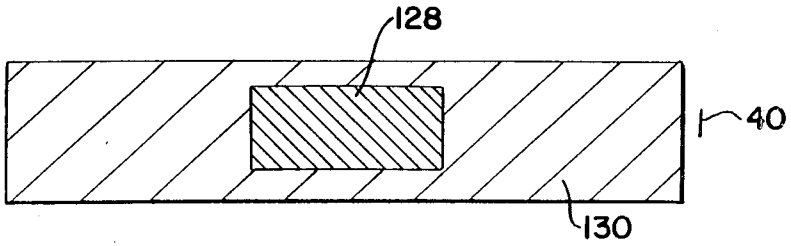
FIG. 6 is a side view in section through the cylinder which comprises a puck.

FIG. 6 shows puck 40 in cross section through its diameter. A weighted central core 128 is surrounded by body 130 comprising a lighter material, the surface of which can move across the playing surface 4, preferably with relatively little friction.

Many variations of the game can be imagined, for example: giving weighted scores to goals partially closed by closures, handicapping a player by partial closure of his opponent's goal, having one or more goals either open or closed, using between one and four players, and using between one and four pucks. Various lines such as 140, 150 (FIG. 1) are provided to mark off various zones, from which given players may or may not be allowed to project a puck.

In a four player game, for example, the playing field would be divided into quadrants by lines 150, 151, 152 and 153. Each player may launch the puck whenever it lands within his quadrant. While he is using his squeezer to launch the puck, his three apponents attempt to block their own goal areas by strategically placing their squeezers so that they will deflect any shot into their goals. Some shots will be deflected off the fingerguards, some shots will be deflected by the arms of the squeezer and some shots will land between the arms of the squeezer in such a way that they may be fired back immediately or fired in an entirely unexpected direction toward the goal of another player. The high speed of the puck, combined with the possibility of immediate return, and the plurality of goals make for a fast moving, interesting and exciting game.

I claim:

1. Squeeze apparatus, for propelling a puck means, said squeeze apparatus comprising:

a pair of arms;

each arm connected to the other by spring means; and said spring means connecting the arms and biasing the arms towards an acute angle to each other;

each arm comprising an outer surface, an inner surface, a proximal end at the spring means, and a distal end opposite the proximal end, the outer surface of each arm having finger-guard means for protecting a player's fingers from fast-moving pucks, said finger-guard means comprising a guard at the distal end which guard extends in a proximal direction for a substantial distance to cover the player's fingers.

2. Apparatus according to claim 1 in which the ridge means is disposed in parallel spaced relationship to a bottom edge of the inner surface, so that when the apparatus is placed on a flat surface, said ridge and flat surface cooperate to define a channel.

3. Gaming apparatus comprising the squeeze apparatus of claim 1, and further comprising:

puck means in the form of a cylindrical disc; and playing field means comprising:

wall means suitable for bounding an area on a flat surface to define a playing surface, and goal means formed by barrier means for spanning adjacent walls.

4. Apparatus according to claim 1 in which the arms have substantially straight inside surfaces biased to an angle of approximately fifty-five degrees.

5. Squeeze apparatus, for propelling a puck means, said squeeze apparatus comprising:

a pair of arms, each arm comprising an inner surface and having a length;

each arm connected to the other by spring means; and said spring means connecting the arms and biasing the arms towards an acute angle to each other;

in which the inner surface comprises a ridge means for preventing upward displacement of the puck, said ridge means disposed longitudinally on substantially the entire length of said inner surface, and in which the outer surface of each arm has lip means at the proximal end for preventing fingers from slipping.

6. Gaming apparatus comprising squeeze apparatus, for propelling a puck, said squeeze apparatus comprising:

a pair of relatively rigid arms; each arm connected to the other by spring means; and said spring means connecting the arms and biasing the arms towards an acute angle to each other;

said gaming apparatus further comprising:

puck means in the form of a cylindrical disc; and playing field means comprising:

wall means suitable for bounding an area on a flat surface to define a playing surface, and goal means comprising:

pedestal means, mountable in a horizontally secure fashion, in either of two opposite orientations;

hinge means mounted on the pedestal means; and barrier means, pivotally attached by the hinge means to the pedestal means, said barrier means oriented horizontally across a barrier side of the pedestal means, the goal means thus having a barrier side and a pedestal side, so that when the puck means collides with the barrier means from a direction on the barrier side, any motion of the barrier is halted by the pedestal means, and the puck means rebounds; but if the puck means collides with the barrier means from a direction on the pedestal's side, the barrier means pivots up on its hinges and allows the puck means to pass, the goal means comprising means for spanning adjacent walls to define a corner.

7. Goal means for a game, said goal means comprising;

pedestal means, mountable in a horizontally secure fashion, in either of two opposed orientations;

hinge means mounted on the pedestal means;

barrier means, pivotally attached by the hinge means to the pedestal means, said barrier means oriented horizontally across a barrier side of the pedestal means, said goal means thus having its barrier side and a pedestal side, so that when a puck collides with the barrier means from a direction on the barrier side, any motion of the barrier means is halted by the pedestal means, and the puck rebounds, but if the puck collides with the barrier means from a direction on the pedestal side, the barrier means pivots up on its hinges and allows the puck to pass; and bridge means, joining the pedestal means across the top of said pedestal means; said pedestal means comprising a plurality of pedestals, an outer two of which pedestals are mountable on a wall means, across an angle formed at a corner of a playing field means.

8. Gaming apparatus according to claim 7 in which:

the wall means comprises a plurality of walls for forming corners having angles; and the goal means are also means for spanning adjacent walls of said corners, triangulating the walls, and fixing the angles of the corners.

9. Gaming apparatus according to claim 7 in which the pedestal means further comprises two central pedestals.

10. Gaming apparatus according to claim 9 in which the hinge means are mounted on the central pedestals.

11. Gaming apparatus according to claim 10 in which the pedestals define a plurality of openings.

12. Gaming apparatus according to claim 11 in which closure means are provided to optionally close one of the openings.

13. Gaming apparatus comprising squeeze apparatus, for propelling a puck, said squeeze apparatus comprising:

a pair of arms;

each arm connected to the other by spring means; and said spring means connecting the arms and biasing the arms towards an acute angle to each other;

said gaming apparatus further comprising:

puck means in the form of a cylindrical disc; and playing field means comprising:

wall means suitable for bounding an area on a flat surface to define a playing surface, and goal means comprising:

pedestal means, mountable in a horizontally secure fashion, in either of two opposite orientations;

hinge means mounted on the pedestal means;

barrier means, pivotally attached by the hinge means to the pedestal means, said barrier means oriented horizontally across a barrier side of the pedestal means, the goal means thus having a barrier side and a pedestal side, so that when the puck means collides with the barrier means from a direction on the barrier side, any motion of the barrier is halted by the pedestal means, and the puck means rebounds;

but if the puck means collides with the barrier means from a direction on the pedestal's side, the barrier means pivots up on its hinges and allows the puck means to pass; and bridge means, joining the pedestal means across the top of said pedestal means; said pedestal means comprising a plurality of pedestals, an outer two of which pedestals are mountable on the wall means, across an angle formed at a corner of the playing field means.

14. Gaming apparatus according to claim 13 in which the pedestal means further comprises two central pedestals.

15. Gaming apparatus according to claim 14 in which the hinge means are mounted on the central pedestals.

16. Gaming apparatus according to claim 15 in which the pedestals define a plurality of openings.

17. Gaming apparatus according to claim 16 in which closure means are provided to optionally close one of the openings.

18. Squeeze apparatus for propelling a puck means, said squeeze apparatus comprising:

a pair of arms;

each arm connected to the other by spring means;

said spring means connecting the arms and biasing the arms toward an acute angle to each other, at which angle said arms comprise means for blocking puck motion;

each arm comprising an outer surface, an inner surface, a proximal end at the spring means, and a distal end opposite the proximal end, the outer surface of each arm having finger-guard means for protecting a player's fingers from fast-moving pucks, said finger-guard means comprising a guard at the distal end of the arm, which guard extends in a proximal direction for a substantial distance to cover the player's fingers;

said inner surface of each arm comprising a ridge means for preventing upward displacement of the puck, said ridge means disposed longitudinally on substantially the entire length of said inner surface.

19. Apparatus according to claim 18 in which the acute angle is approximately fifty-five degrees.

* * * * *